US008737895B2

(12) United States Patent
Suzuki et al.

(10) Patent No.: US 8,737,895 B2
(45) Date of Patent: May 27, 2014

(54) FIXING DEVICE PROVIDED WITH LUBRICANT AGENT RETAINING PORTION

(75) Inventors: Noboru Suzuki, Komaki (JP); Kei Ishida, Nagoya (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 67 days.

(21) Appl. No.: 13/426,648

(22) Filed: Mar. 22, 2012

(65) Prior Publication Data

US 2012/0275830 A1 Nov. 1, 2012

(30) Foreign Application Priority Data

Apr. 28, 2011 (JP) ..... 2011-101159

(51) Int. Cl.
*G03G 15/20* (2006.01)

(52) U.S. Cl.
USPC ..... 399/329

(58) Field of Classification Search
USPC ..... 399/328, 329, 335, 336; 219/216
See application file for complete search history.

(56) References Cited

U.S. PATENT DOCUMENTS

| | | | | |
|---|---|---|---|---|
| 5,278,618 | A * | 1/1994 | Mitani et al. | 399/329 |
| 7,027,763 | B2 | 4/2006 | Kato et al. | |
| 7,235,761 | B1 * | 6/2007 | Maul et al. | 219/216 |
| 7,386,265 | B2 | 6/2008 | Ito et al. | |
| 7,406,286 | B2 | 7/2008 | Yoshioka et al. | |
| 7,437,110 | B2 * | 10/2008 | Kondo et al. | 399/320 |
| 7,890,040 | B2 | 2/2011 | Lee et al. | |
| 7,986,909 | B2 | 7/2011 | Nanba | |
| 8,032,069 | B2 * | 10/2011 | Shin et al. | 399/329 |
| 8,121,528 | B2 * | 2/2012 | Pawlik et al. | 399/329 |
| 8,606,135 | B2 | 12/2013 | Yamashina et al. | |
| 2004/0151522 | A1 | 8/2004 | Kato et al. | |
| 2010/0266319 | A1 | 10/2010 | Matsuoka et al. | |
| 2010/0290822 | A1 | 11/2010 | Hasegawa et al. | |

(Continued)

FOREIGN PATENT DOCUMENTS

| | | |
|---|---|---|
| JP | 04-044074 | 2/1992 |
| JP | 07-287461 | 10/1995 |

(Continued)

OTHER PUBLICATIONS

U.S. Appl. No. 13/426,662, filed Mar. 22, 2012.

(Continued)

*Primary Examiner* — Robert Beatty
(74) *Attorney, Agent, or Firm* — Banner & Witcoff, Ltd.

(57) ABSTRACT

A fixing device for thermally fixing a developing agent image to a sheet fed in a sheet feeding direction includes: a tubular member; a heater; a nip member; and a backup member. The nip member made of a metal plate includes: a base portion; a connecting portion; and a flange portion. The base portion is plate-shaped. A nip region for nipping the tubular member between the backup member and the nip member is defined exclusively by the base portion and the backup member. The connecting portion extends from the base portion in a direction away from the backup member. The flange portion extends from the connecting portion in a direction opposite to the sheet feeding direction. The connecting portion and the flange portion define a retaining portion at a position confronting an inner peripheral surface of the tubular member for retaining a lubricant agent therein.

10 Claims, 7 Drawing Sheets

(56) References Cited

U.S. PATENT DOCUMENTS

| | | | | |
|---|---|---|---|---|
| 2011/0150543 | A1 | 6/2011 | Fujiwara et al. | |
| 2011/0158716 | A1 | 6/2011 | Fujiwara et al. | |
| 2011/0170920 | A1 | 7/2011 | Fujiwara et al. | |
| 2012/0275831 | A1* | 11/2012 | Ishida et al. | 399/329 |
| 2013/0071157 | A1* | 3/2013 | Suzuki et al. | 399/329 |

FOREIGN PATENT DOCUMENTS

| | | | |
|---|---|---|---|
| JP | 08-248791 | | 9/1996 |
| JP | 2003-223064 | | 8/2003 |
| JP | 2003-295671 | | 10/2003 |
| JP | 2004-184814 | | 7/2004 |
| JP | 2004286933 | A * | 10/2004 |
| JP | 2005-114959 | | 4/2005 |
| JP | 2005242113 | A * | 9/2005 |
| JP | 2006-047769 | | 2/2006 |
| JP | 2010-009781 | | 1/2010 |
| JP | 2010-230774 | | 10/2010 |
| JP | 2010-286815 | | 12/2010 |
| JP | 2010282237 | A * | 12/2010 |
| JP | 2011033654 | A * | 2/2011 |
| JP | 2011-095549 | | 5/2011 |
| JP | 2011-095550 | | 5/2011 |
| JP | 2011-137933 | | 7/2011 |

OTHER PUBLICATIONS

U.S. Appl. No. 13/426,653, filed Mar. 22, 2012.
U.S. Appl. No. 13/426,656, filed Mar. 22, 2012.
Non-Final Office Action received in U.S. Appl. No. 13/426,662 mailed Oct. 23, 2013.
Notice of Allowance issued in U.S. Appl. No. 13/426,653 mailed Jan. 30, 2014.

* cited by examiner

FIXING DEVICE PROVIDED WITH LUBRICANT AGENT RETAINING PORTION

CROSS REFERENCE TO RELATED APPLICATION

This application claims priority from Japanese Patent Application No. 2011-101159 filed Apr. 28, 2011. The entire content of the priority application is incorporated herein by reference. The present application closely relates to a co-pending US patent application (based on Japanese patent application No. 2011-101167 filed Apr. 28, 2011) which is incorporated by reference.

TECHNICAL FIELD

The present invention relates to a fixing device that thermally fixes a transferred developing agent image to a sheet.

BACKGROUND

A conventional fixing device employed for an electrophotographic type image forming device includes a circularly movable tubular fusing belt having an inner peripheral surface defining an internal space, a halogen lamp disposed within the internal space, a pressing pad with which the inner peripheral surface is in sliding contact, and a pressure roller for nipping the fusing belt in cooperation with the pressing pad.

In one such fixing device, the pressing pad is formed with depressed portions at positions contacting the inner peripheral surface of the fusing belt. The depressed portions retain a lubricant agent therein. The lubricant agent reduces friction between the pressing pad and the fusing belt, thereby enabling the fusing belt to circularly move smoothly.

SUMMARY

However, in the above-described conventional fixing device, the depressed portions retaining the lubricant agent therein are formed on a surface of the pressing pad that the fusing belt (tubular member) slidably contacts. Due to the irregular surface of the pressing pad, specific parts of the tubular member may be subjected to a force when the tubular member is conveyed between the pressing pad and the pressure roller.

In view of the foregoing, it is an object of the present invention to provide a fixing device that enables a tubular member to circularly move smoothly without exerting a force on specific parts of the tubular member.

In order to attain the above and other objects, the present invention provides a fixing device for thermally fixing a developing agent image to a sheet fed in a sheet feeding direction including: a flexible tubular member; a heater; a nip member; and a backup member. The nip member includes: a base portion; a connecting portion; and a flange portion. The flexible tubular member has an inner peripheral surface defining an internal space. The heater is disposed in the internal space. The nip member is disposed in the internal space and made of a metal plate. The inner peripheral surface is configured to be in sliding contact with the nip member. The backup member is configured to provide a nip region in cooperation with the nip member for nipping the flexible tubular member between the backup member and the nip member. The base portion has a plate-shaped configuration provided with a first end and a second end positioned downstream of the first end in the sheet feeding direction. The nip region is defined exclusively by the base portion and the backup member. The connecting portion extends from the first end of the base portion in a direction away from the backup member. The connecting portion has a first end and a second end connected to the first end of the base portion. The flange portion extends from the first end of the connecting portion in a direction opposite to the sheet feeding direction. The connecting portion and the flange portion define a retaining portion at a position confronting the inner peripheral surface of the flexible tubular member for retaining a lubricant agent therein. The retaining portion is formed by curving the metal plate.

DETAILED DESCRIPTION

Next, a general structure of a laser printer 1 as an image forming device provided with a fixing device 100 according to one embodiment of the present invention will be described with reference to FIG. 1. A detailed structure of the fixing device 100 will be described later while referring to FIGS. 2A to 4.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

<General Structure of Laser Printer>

Figure 1:
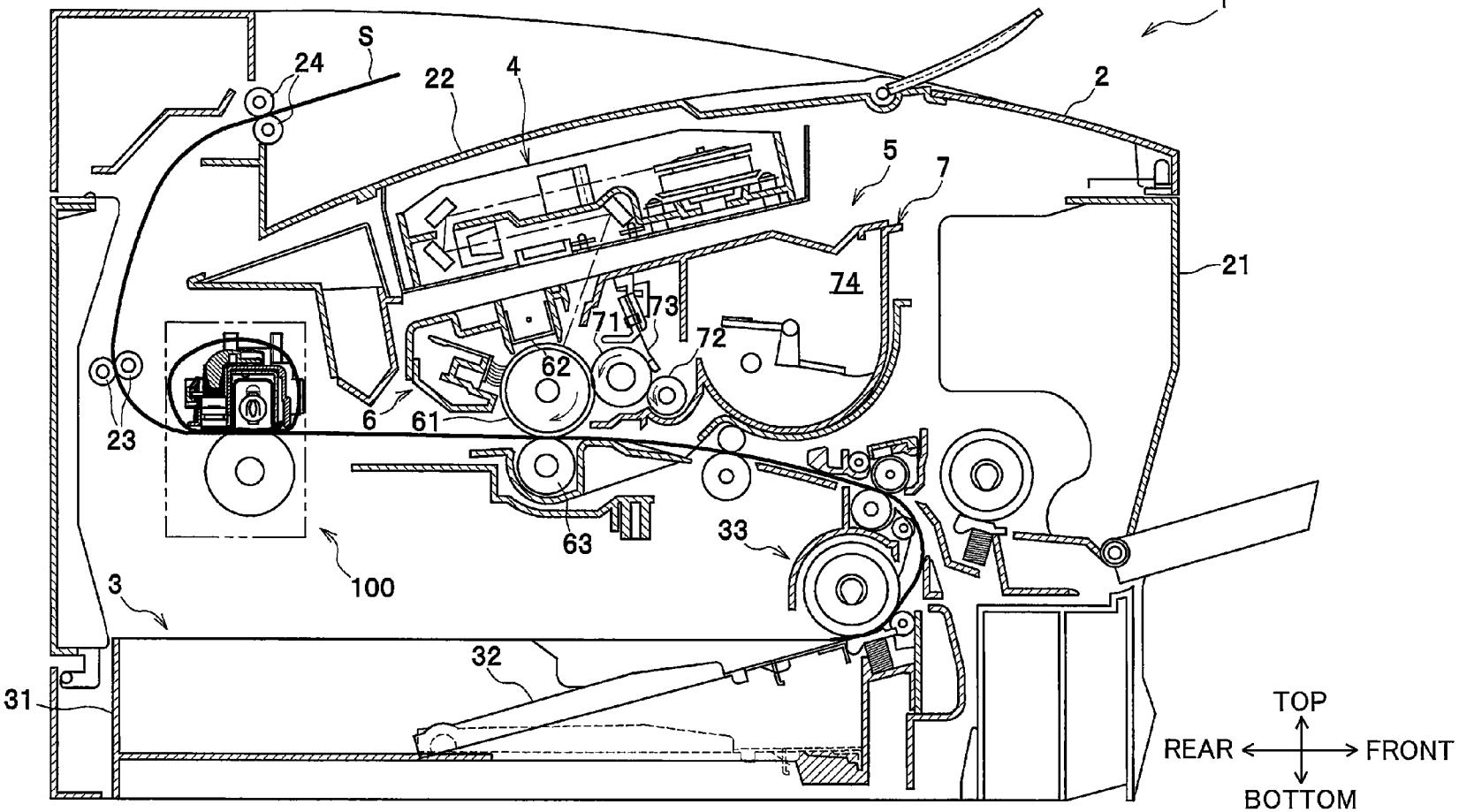
FIG. 1 is a schematic cross-sectional view showing a structure of a laser printer having a fixing device according to one embodiment of the present invention.

As shown in FIG. 1, the laser printer 1 includes a main frame 2 with a movable front cover 21. Within the main frame 2, a sheet supply unit 3 for supplying a sheet S, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31, a lifter plate 32, and a sheet feeding mechanism 33. Each sheet S accommodated in the sheet supply tray 31 is directed upward by the lifter plate 32, and conveyed toward the process cartridge 5 (i.e. between a photosensitive drum 61 and a transfer roller 63) by the sheet feeding mechanism 33.

The exposure unit 4 is disposed at an upper portion of the main frame 2. The exposure unit 4 includes a laser emission unit (not shown), a polygon mirror (shown but without a reference numeral), lenses (shown but without reference numerals), and reflection mirrors (shown but without reference numerals). In the exposure unit 4, the laser emission unit irradiates a laser beam (indicated by a chain line in FIG. 1) based on image data, thereby exposing a surface of the photosensitive drum 61 with high speed scan of the laser beam.

The process cartridge 5 is disposed below the exposure unit 4. The process cartridge 5 is detachable from or attachable to the main frame 2 through a front opening defined when the front cover 21 of the main frame 2 is open. The process cartridge 5 includes a drum unit 6 and a developing unit 7.

The drum unit 6 includes the photosensitive drum 61, a charger 62, and a transfer roller 63. The developing unit 7 is detachably mounted in the drum unit 6. The developing unit 7 includes a developing roller 71, a supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner then enters between the developing roller 71 and the thickness-regulation blade 73 to be carried on the developing roller 71 as a thin layer having a uniform thickness.

The toner carried on the developing roller 71 is supplied to the electrostatic latent image formed on the photosensitive drum 61. Hence, a visible toner image corresponding to the electrostatic latent image is formed on the photosensitive drum 61. Then, the sheet S is conveyed between the photosensitive drum 61 and the transfer roller 63, so that the toner image formed on the photosensitive drum 61 is transferred onto the sheet S.

The fixing device 100 is disposed rearward of the process cartridge 5. The toner image (toner) transferred onto the sheet S is thermally fixed onto the sheet S while the sheet S passes through the fixing device 100. The sheet S on which the toner image is thermally fixed is conveyed by conveying rollers 23, 24 to be discharged onto a discharge tray 22 formed on the top of the main frame 2.

<Detailed Structure of Fixing Device>

Figure 2A:
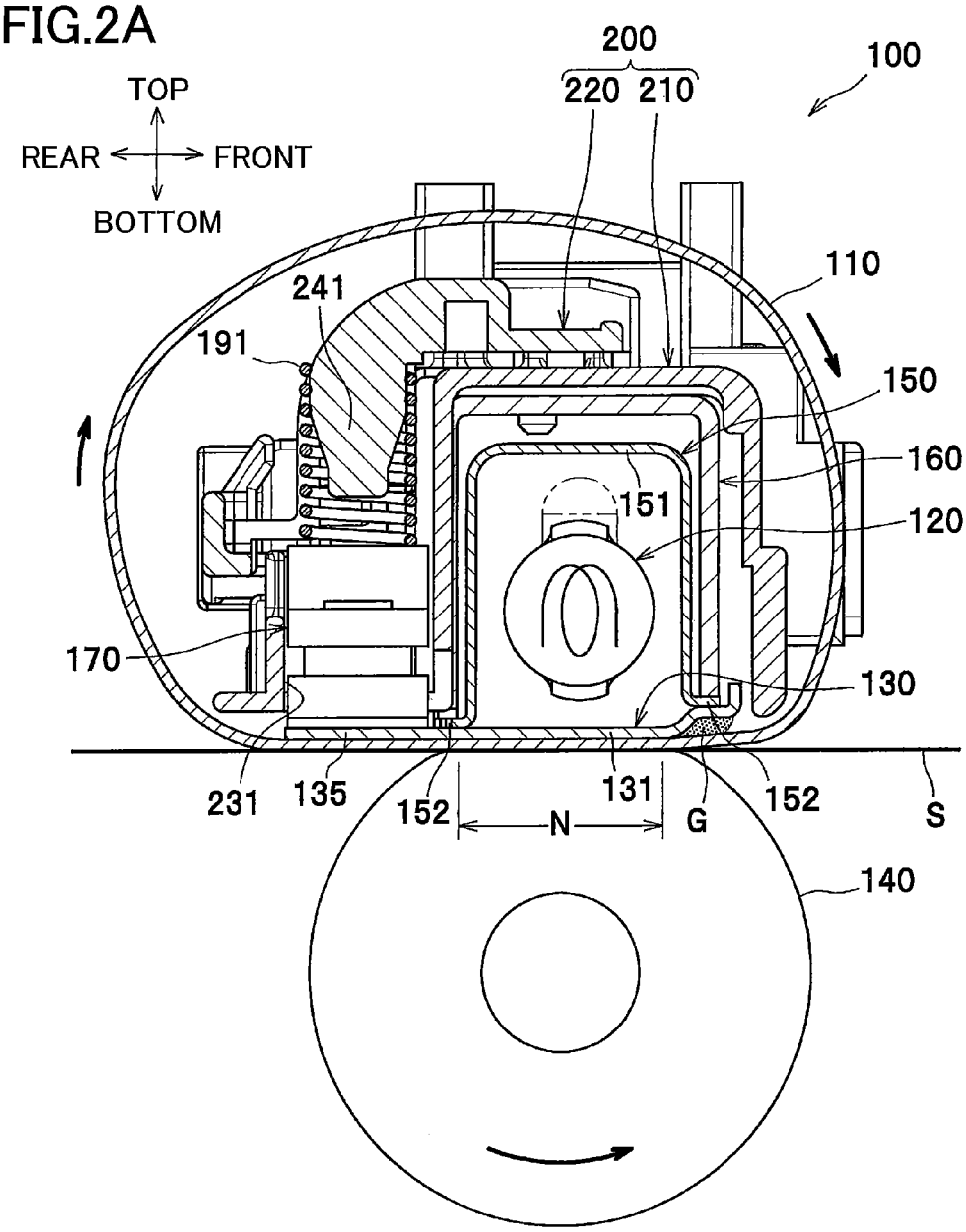
FIG. 2A is a schematic cross-sectional view of the fixing device according to the embodiment.

As shown in FIG. 2A, the fixing device 100 includes a flexible tubular fusing belt (tubular member) 110, a halogen lamp (heater) 120, a nip plate (nip member) 130, a pressure roller (backup member) 140, a reflection member 150, a stay 160, a thermostat (temperature detecting member) 170, two thermistors (temperature detecting member) 180 (shown in FIG. 4), and a frame unit 200.

The fusing belt 110 is an endless belt having a tubular configuration with heat resistivity and flexibility. The fusing belt 110 has an inner peripheral surface defining an internal space within which the halogen lamp 120, the nip plate 130, the reflection member 150, the stay 160, the thermostat 170, and the thermistors 180, and the frame unit 200 are disposed. The fusing belt 110 has widthwise (right and left) end portions that are respectively guided by guide members (not shown) fixed to a casing (not shown) of the fixing device 100 so that the fusing belt 110 is circularly movable.

The fusing belt 110 may be formed of any material. For example, the fusing belt 110 may be formed of metal such as stainless steel, or resin such as polyimide resin, or elastic material such as rubber.

Further, the fusing belt 110 may be of a multilayered configuration. The fusing belt 110 may be a metal belt whose outer peripheral surface has a resin layer for reducing sliding resistance, or alternatively, an elastic layer such as a rubber layer.

The halogen lamp 120 is a heater to generate a radiant heat to heat the nip plate 130 and the fusing belt 110 (nip region N) for heating toner on the sheet S. The halogen lamp 120 is positioned at the internal space of the fusing belt 110 such that the halogen lamp 120 is spaced away from the inner peripheral surface of the fusing belt 110 as well as an inner (upper) surface of the nip plate 130 by a predetermined distance.

Figure 3:
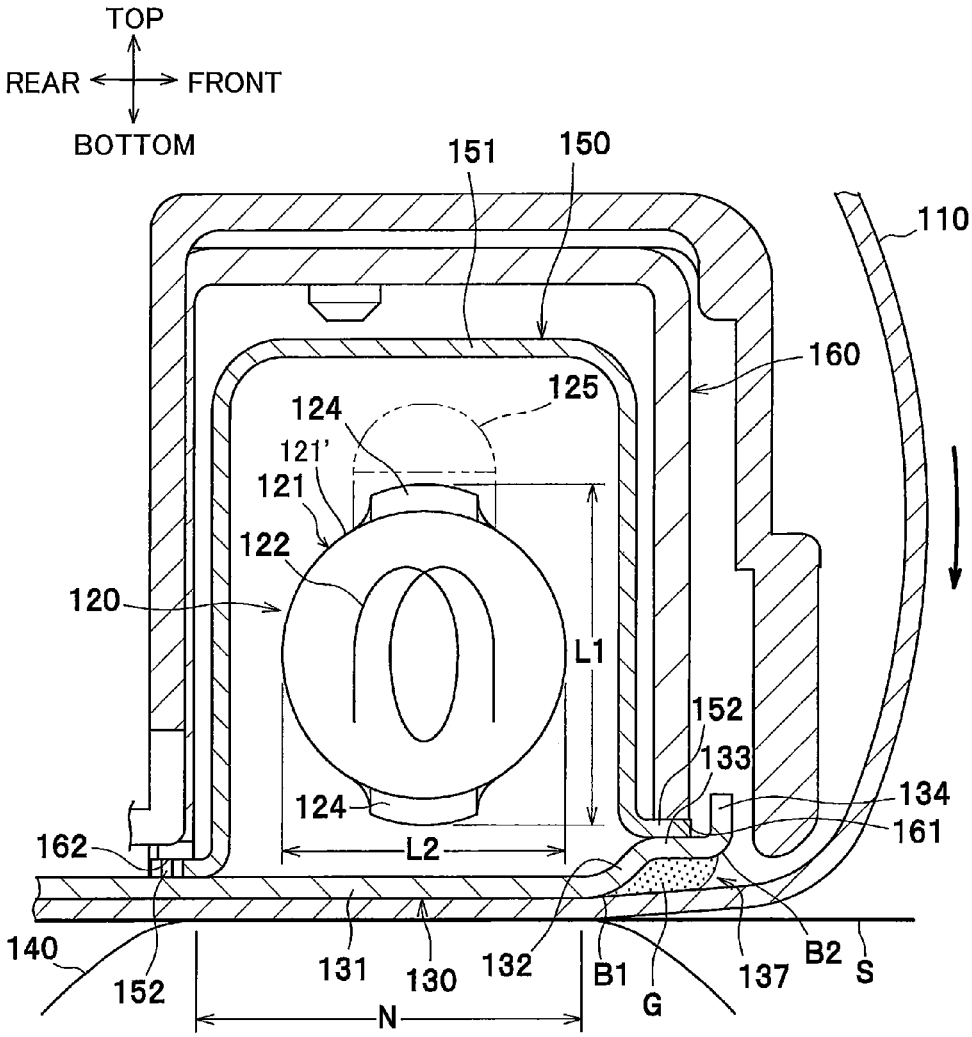
FIG. 3 is an enlarged cross-sectional view of the fixing device according to the embodiment.
Figure 4:
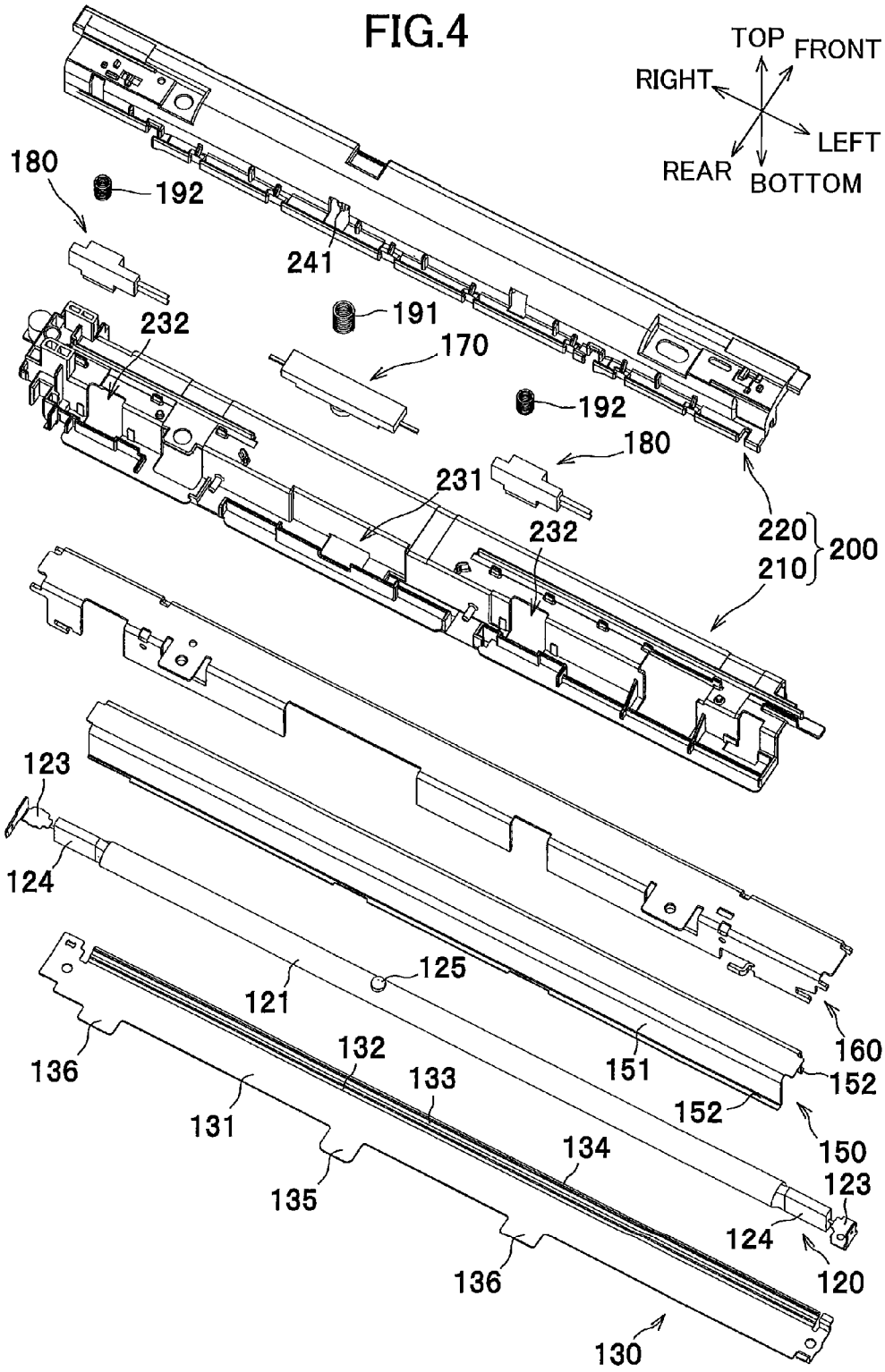
FIG. 4 is an exploded perspective view showing a nip plate, a halogen lamp, a reflection plate, a stay, a thermostat, thermistors, and a frame unit provided in the fixing device according to the embodiment.

As shown in FIGS. 3 and 4, the halogen lamp 120 includes a glass tube 121, a spirally-coiled filament 122 as a heat source, a pair of electrodes 123, and an inert gas including halogen elements. The glass tube 121 has a generally cylindrical configuration elongated in a rightward/leftward direction. The halogen lamp 120 is fabricated such that the filament 122 and the inert gas are sealed in the glass tube 121 with widthwise (right and left) ends of the glass tube 121. The pair of electrodes 123 is electrically connected to respective widthwise (right and left) ends of the filament 122.

The glass tube 121 has a glass tube body 121', sealed portions 124, and a tip portion (projection) 125. The sealed portions 124 are formed integrally with widthwise (right and left) end portions of the glass tube body 121' for sealing the filament 122 and the inert gas in the glass tube body 121'. Each sealed portion 124 is formed in a generally plate shape extending in a radial direction of the glass tube body 121' (i.e. upward/downward direction). Further, each sealed portion 124 protrudes radially outwardly from the glass tube body 121' when viewing in an axial direction of the glass tube body 121' (i.e. rightward/leftward direction).

The tip portion 125 is inevitably formed for sealing the inert gas in the glass tube 121. The tip portion 125 is formed integrally with the glass tube body 121'. The tip portion 125 protrudes radially outwardly from the glass tube body 121' when viewing in the axial direction of the glass tube body 121'. More specifically, the tip portion 125 protrudes radially upwardly from the glass tube body 121' in a direction that the sealed portion 124 is oriented. In other words, the tip portion 125 is arranged superposed with a portion of each sealed portion 124 protruding from the glass tube body 121' when viewing in the axial direction of the glass tube body 121' (FIG. 3).

Each sealed portion 124 is oriented in a predetermined direction and defines a cross-sectional distance L1 between an uppermost portion of the sealed portion 124 and a lowermost portion of the sealed portion 124 in a confronting direction that the halogen lamp 120 confronts the nip plate 130 (i.e. upward/downward direction) greater than a cross-sectional length L2 of the glass tube 121 in a perpendicular direction that is perpendicular to the confronting direction and the axial direction (i.e. frontward/rearward direction).

More specifically, in the present embodiment, the halogen lamp 120 is oriented such that each sealed portion 124 extends in the upward/downward direction. That is, each sealed portion 124 protrudes radially upwardly and downwardly from the glass tube body 121' when viewing in the axial direction of the glass tube body 121'.

Because of the above-described difference in the cross-sectional distance L1 and the cross-sectional length L2, front and rear side walls of the reflection member 150 and a front and rear side walls of the stay 160 can be positioned close to the halogen lamp 120. Thus, a compact halogen lamp 120 in the frontward/rearward direction can be provided, which leads to the compact nip plate 130, reflection member 150, and stay 160 in the frontward/rearward direction.

The nip plate 130 is adapted for receiving the radiant heat from the halogen lamp 120. To this effect, the nip plate 130 is positioned to be stationary such that the inner peripheral surface of the fusing belt 110 is moved slidably with a lower surface of the nip plate 130.

In the present embodiment, the nip plate 130 is made from a material such as aluminum having a thermal conductivity higher than that of the stay 160 (described later) made from a steel. More specifically, for fabricating the nip plate 130, a metal plate such as an aluminum plate is bent to provide a base portion 131, a connecting portion 132, a flange portion 133, and a prevention portion 134.

The base portion 131 is formed in a plate shape extending flat in the frontward/rearward direction. The inner peripheral surface of the fusing belt 110 is moved slidably with a lower surface of the base portion 131, so that the base portion 131 exclusively nips the fusing belt 110 in cooperation with the pressure roller 140. The lower surface of the base portion 131 is substantially uniformly flat across the entire region in a sheet feeding direction of the sheet S (i.e. frontward/rearward direction) as well as in an axial direction of the fusing belt 110 (i.e. rightward/leftward direction).

As shown in FIG. 4, the base portion 131 has a rear end portion positioned downstream of a front end thereof in the sheet feeding direction. The rear end portion is provided with a first protruding portion 135 and two second protruding portions 136, each protruding in the sheet feeding direction from the rear end portion. That is, the first protruding portion 135 and the second protruding portions 136 protrude rearward from the rear end portion. The first protruding portion 135 and the second protruding portions 136 are formed in a generally plate shape.

The first protruding portion 135 is positioned at a center portion of the base portion 131 in the rightward/leftward direction. The first protruding portion 135 has an upper surface in direct confrontation with the thermostat 170.

The two second protruding portions 136 are positioned at a right end portion of the base portion 131 and the center portion thereof in the rightward/leftward direction, respectively. The second protruding portions 136 have respective upper surfaces in direct confrontation with the thermistors 180.

Returning to FIG. 3, the connecting portion 132 extends diagonally upward and frontward from the front end portion of the base portion 131 positioned upstream of the rear end portion thereof in the sheet feeding direction. That is, the connecting portion 132 extends from the base portion 131 in a direction away from the pressure roller 140. The connecting portion 132 is formed so as to connect the base portion 131 and the flange portion 133. The connecting portion 132 has a front end portion, and a rear end portion positioned downstream of the front end portion in the sheet feeding direction.

The flange portion 133 extends in a direction opposite to the sheet feeding direction from the front end portion of the connecting portion 132 positioned upstream of the rear end portion thereof in the sheet feeding direction. That is, the flange portion 133 extends frontward from the connecting portion 132. The flange portion 133 has a front end portion, and a rear end portion positioned downstream of the front end portion in the sheet feeding direction. The connecting portion 132 and the flange portion 133 form a generally inverted V-shape to define a retaining portion 137 confronting the inner peripheral surface of the fusing belt 110. The retaining portion 137 is adapted to retain a lubricant agent G therein.

The lubricant agent G retained in the retaining portion 137 enters between the nip plate 130 (the base portion 131) and the fusing belt 110 in association with circular movement of the fusing belt 110, thereby reducing friction between the nip plate 130 and the fusing belt 110. As the lubricant agent G, a heat resisting fluorine grease is available, for example.

The prevention portion 134 extends in the direction away from the pressure roller 140 from the front end portion of the flange portion 133 positioned upstream of the rear end portion thereof in the sheet feeding direction. That is, the prevention portion 134 extends upward from the flange portion 133. The prevention portion 134 is formed so as to cover a flange portion 152 of the reflection member 150 nipped between the nip plate 130 and the stay 160 when viewing in the sheet feeding direction. That is, the flange portion 133 of the nip plate 130 and a lower end portion 161 of the front side wall of the stay 160 are adjoined to each other to define an adjoining region therebetween, and the prevention portion 134 is provided to cover the adjoining region.

Since the prevention portion 134 serves as a barrier against the lubricant agent G, the prevention portion 134 can prevent the lubricant agent G from running over an upper surface of the nip plate 130, that is, a surface opposite to the lower surface of the nip plate 130 with which the fusing belt 110 is in sliding contact. Further, the prevention portion 134 can prevent the lubricant agent G from entering into the adjoining region. Hence, unintentional consumption of the lubricant agent G retained between the nip plate 130 and the fusing belt 110 can be restrained.

Further, the base portion 131 and the connecting portion 132 define a first curved portion B1 therebetween, and the flange portion 133 and the prevention portion 134 define a second curved portion B2 therebetween. In the present embodiment, the first curved portion B1 has a curvature smaller than that of the second curved portion B2. In other words, the first curved portion B1 has a generally obtuse angle, while the second curved portion B2 has a generally right angle.

Here, the first curved portion B1 is positioned at the front end portion of the base portion 131. Due to this configuration, the inner peripheral surface of the fusing belt 110 may frictionally contact the first curved portion B1 when conveyed between the nip plate 130 (the base portion 131) and the pressure roller 140. The first curved portion B1 is formed so as to have a small coverture, therefore, increase in torque associated with circular movement of the fusing belt 110, and damage to the inner peripheral surface of the fusing belt 110 such as scratches and frictional wearing can be restrained.

As shown in FIG. 2A, the pressure roller 140 is positioned below the nip plate 130 and nips the fusing belt 110 in cooperation with the nip plate 130 to provide the nip region N for nipping the sheet S between the pressure roller 140 and the fusing belt 110. In the present embodiment, the nip region N is defined exclusively by the base portion 131 of the nip plate 130 and the backup member 140 (FIG. 3).

The pressure roller 140 may press the nip plate 130 through the fusing belt 110 for providing the nip region N between the pressure roller 140 and the fusing belt 110. Alternatively, the nip plate 130 may press the pressure roller 140 through the fusing belt 110 for providing the nip region N between the pressure roller 140 and the fusing belt 110.

The pressure roller 140 is rotationally driven by a drive motor (not shown) disposed in the main frame 2. By the rotation of the pressure roller 140, the fusing belt 110 is circularly moved along the nip plate 130 because of a friction force generated therebetween or between the sheet S and the fusing belt 110. A toner image on the sheet S can be thermally fixed thereto by heat and pressure during passage of the sheet S at the nip region N between the pressure roller 140 and the fusing belt 110.

Figure 2B:
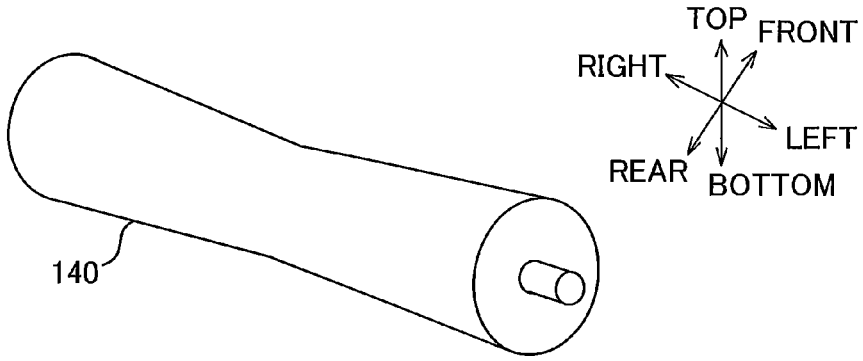
FIG. 2B is a schematic perspective view of a pressure roller provided in the fixing device according to the embodiment.

As shown in FIG. 2B, in the present embodiment, the pressure roller 140 is formed in an inverted crown shape having a diameter gradually increasing toward each widthwise (right and left) end thereof. The inverted crown shaped pressure roller 140 can prevent the fusing belt 110 from being crumpled and being displaced rightward or leftward while the fusing belt 110 is conveyed between the nip plate 130 and the pressure roller 140.

The reflection member 150 is adapted to reflect the radiant heat (radiating frontward, rearward, and upward) from the halogen lamp 120 toward the nip plate 130. The reflection member 150 is positioned within the fusing belt 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing belt 110.

The reflection member 150 is configured into U-shape in cross-section and is made from a material such as aluminum having high reflection ratio regarding infrared ray and far infrared ray. The reflection member 150 has a U-shaped reflection portion 151, and front and rear flange portions 152 extending outward in the frontward/rearward direction from front and rear end portions of the reflection portion 151.

The stay 160 is adapted to support the front and rear end portions of the nip plate 130. The stay 160 is positioned within the fusing belt 110 and covers the halogen lamp 120 and the reflection member 150. For fabricating the stay 160, a highly rigid member such as a steel plate is folded into U-shape in conformity with the outer shape of the reflection portion 151 to have a top wall, a front side wall, and a rear side wall.

More specifically, the stay 160 is positioned at a side opposite to the pressure roller 140 relative to the nip plate 130. As shown in FIG. 3, the front side wall of the stay 160 is provided with a lower end portion 161, and the rear side wall of the stay 160 is provided with a lower end portion 162. The lower end portion 161 supports the flange portion 133 of the nip plate 130 via the front flange portion 152 of the reflection member 150 from above, while the lower end portion 162 supports the rear end portion of the base portion 131 via the rear flange portion 152 of the reflection member 150 from above. The rear end portion of the base portion 131 supported by the lower end portion 162 is positioned downstream of the nip region N.

When a force directed upward is applied to the nip plate 130 from below (a pressure roller 140 side), the stay 160 receives the force to support the nip plate 130. Note that the term "force" here implies a pressure force from the pressure roller 140 when the fixing device 100 has a configuration such that the pressure roller 140 presses the nip plate 130. Alternatively, when the fixing device 100 has a configuration such that the nip plate 130 presses the pressure roller 140, the term "force" here implies a reactive force associated with a pressure force that the nip plate 130 presses the pressure roller 140.

Because the flange portion 133 and the rear end portion of the base portion 131 are supported to the stay 160 via the front and rear flange portions 152 of the reflection member 150, the upper surface of the base portion 131 and the upper surface of the connecting portion 132 can be positioned in direct confrontation with the halogen lamp 120. As a result, the base portion 131 and the connecting portion 132 are directly heated by radiant heat from the halogen lamp 120 and the reflection member 150.

The thermostat 170 is adapted to detect the temperature of the nip plate 130. As shown in FIGS. 2A and 4, the thermostat 170 is positioned at the internal space defined by the inner peripheral surface of the fusing belt 110 at a position opposite to the halogen lamp 120 with respect to the reflection member 150 and the stay 160.

More specifically, the thermostat 170 has a lower surface serving as a temperature detection surface. The temperature detection surface of the thermostat 170 is positioned in direct confrontation with the upper surface of the first protruding portion 135. Incidentally, the upper surface of the first protruding portion 135 is positioned at a side opposite to the pressure roller 140. The first protruding portion 135 directly protrudes from the base portion 131 that is heated by the halogen lamp 120. Since the thermostat 170 is positioned in direct confrontation with the first protruding portion 135, the temperature of the nip plate 130 can be accurately detected.

Further, the thermostat 170 is fitted in a first positioning portion 231 (described later) provided at the first frame 210 (described later) of the frame unit 200 (described later), so that the thermostat 170 is subjected to positioning in the frontward/rearward direction as well as in the rightward/leftward direction. Further, the thermostat 170 is urged toward the first protruding portion 135 by a coil spring 191 (described later). With this configuration, position of the thermostat 170 relative to the nip plate 130 can be fixed. Consequently, the temperature of the nip plate 130 can be accurately detected.

The thermostat 170 is provided in a power supply circuit (not shown) for supplying electric power to the halogen lamp 120, and is adapted to shut off electric power supply to the halogen lamp 120 upon detection of a temperature exceeding a predetermined temperature. Hence, when the nip plate 130 is overheated, the thermostat 170 shuts off the electric power supply to the halogen lamp 120. Thus, electric power supply to the halogen lamp 120 can be promptly shut off.

Each of the thermistors 180 is a temperature sensor for detecting the temperature of the nip plate 130. Although not shown in the drawing, the two thermistors 180 are positioned at the internal space defined by the inner peripheral surface of the fusing belt 110 at positions opposite to the halogen lamp 120 with respect to the reflection member 150 and the stay 160, in the same manner as the thermostat 170.

More specifically, each thermistor 180 has a lower surface serving as a temperature detection surface. Each temperature detection surface is positioned in direct confrontation with the upper surface of the corresponding second protruding portion 136. Incidentally, the upper surface of each second protruding portion 136 is positioned at a side opposite to the pressure roller 140. Each second protruding portion 136 directly protrudes from the base portion 131. Since the thermistors 180 are positioned in direct confrontation with the second protruding portions 136, respectively, the temperature of the nip plate 130 can be accurately detected.

Further, the thermistors 180 are fitted in second positioning portions 232 (described later) provided at the first frame 210 of the frame unit 200, respectively, so that the thermistors 180 are subjected to positioning in the frontward/rearward direction as well as in the rightward/leftward direction. Further, the thermistors 180 are urged toward the second protruding portions 136 by coil springs 192 (described later), respectively. With this configuration, position of the thermistors 180 relative to the nip plate 130 can be fixed. Consequently, the temperature of the nip plate 130 can be accurately detected.

A control unit (not shown) is provided in the main frame 2, and each thermistor 180 is connected to the control unit for transmitting a detection signal to the control unit. Thus, the temperature of the halogen lamp 120 (fixing device 100) is controlled based on the signal indicative of the detected temperature.

The frame unit 200 is adapted to support the thermostat 170, the thermistors 180, and the coil springs 191, 192. The frame unit 200 is positioned at the internal space defined by the inner peripheral surface of the fusing belt 110 and covers the stay 160. The frame unit 200 includes the first frame 210 and a second frame 220.

The first frame 210 is formed in a U-shape in cross-section. The first frame 210 is positioned opposite to the halogen lamp 120 with respect to the reflection member 150 and the stay 160. The first frame 210 is provided with the first positioning portion 231 in which the thermostat 170 is fitted, and the two second positioning portions 232 in which the two thermistors 180 are respectively fitted.

The second frame 220 is formed in an L-shape in cross-section. The second frame 220 is positioned opposite to the reflection member 150 and the stay 160 with respect to the first frame 210. The second frame 220 is provided with three boss-like supporting portions 241 (only one shown in FIG. 4) for supporting the coil springs 191, 192. The coil springs 191, 192 have top portions engageable with the respective support portions 241. The coil springs 191, 192 are supported to the second frame 220 as a result of engagement of the top portions of the coil springs 191, 192 with the respective support portions 241.

The frame unit 200 (the first frame 210 and the second frame 220) is fixed by threads to the stay 160 having high rigidity. Hence, the thermostat 170 and the thermistors 180 can be stably held by the frame unit 200.

The fixing device 100 according to the above-described embodiment provides the following advantages and effects: The nip plate 130 is provided with the retaining portion 137. The lubricant agent G retained in the retaining portion 137 enters between the base portion 131 and the fusing belt 110, thereby avoiding frictional wearing of the nip plate 130 and the fusing belt 110. Further, the base portion 131 is formed in the plate shape having a generally uniformly flat surface. This configuration is unlikely to exert a force upon a specific part of the fusing belt 110 conveyed between the nip plate 130 and the pressure roller 140. As a result, compared to the conventional art in which a retaining portion for retaining a lubricant agent is formed in a surface of a nip plate with which a fusing belt is in sliding contact, smooth circular movement of the fusing belt 110 can be attained.

Further, a metal plate is curved to form the retaining portion 137. In comparison with a case where a retaining portion is formed in a thick nip plate for retaining a lubricant agent, the nip plate 130 can be made thinner. Therefore, a heat capacity of the nip plate 130 can be reduced. Accordingly, prompt heating to the nip plate 130 can be attained to accelerate start-up timing of the fixing device 100.

Further, prompt heating to the nip plate 130 enables the lubricant agent G that receives heat transmitted from the nip plate 130 to have an appropriate viscosity promptly. Even if the fixing device 100 is operated at a low temperature in winter or in cold climates, the lubricant agent G can be promptly heated to promptly reduce friction between the nip plate 130 and the fusing belt 110. Therefore, even if the fixing device 100 starts operating at a low temperature, smooth circular movement of the fusing belt 110 can be attained.

The connecting portion 132 is positioned in direct confrontation with the halogen lamp 120, because the stay 160 supports the flange portion 133 and the rear end portion of the base portion 131. With this configuration, the retaining portion 137 can be efficiently heated by heat conducted from the connecting portion 132, thereby promptly heating the lubricant agent G retained in the retaining portion 137. Accordingly, even if the fixing device 100 starts operating at a low temperature, smooth circular movement of the fusing belt 110 can be attained.

The nip plate 130 is provided with the prevention portion 134. The prevention portion 134 can prevent the lubricant agent G from entering into the adjoining region defined between the nip plate 130 and the stay 160, thereby restraining unintentional consumption of the lubricant agent G retained between the nip plate 130 and the fusing belt 110. Accordingly, smooth circular movement of the fusing belt 110 can be maintained.

The inverted-crown shaped pressure roller 140 can restrain the fusing belt 110 conveyed between the nip plate 130 and the pressure roller 140 from being crumpled or from being displaced rightward or leftward.

The thermostat 170 and the thermistors 180 are respectively positioned in confrontation with the upper surfaces of the first protruding portion 135 and of the second protruding portions 136 formed integral with and protruding from the base portion 131. Consequently, the thermostat 170 and the thermistors 180 can accurately detect the temperature of the nip plate 130 to enhance accuracy of temperature control in the fixing device 100.

The sealed portions 124 of the halogen lamp 120 protrude radially outwardly from the glass tube body 121' when viewing in the axial direction of the glass tube body 121'. Each sealed portion 124 is oriented in a predetermined direction and defines the cross-sectional distance L1 in the upward/downward direction greater than the cross-sectional length L2 in the frontward/rearward direction. Thus, the compact halogen lamp 120 in the frontward/rearward direction can be provided, which leads to the compact nip plate 130, reflection member 150, and stay 160 in the frontward/rearward direction.

As a result, the compact fixing device 100 can also be attained. Further, the compact nip plate 130 reduces heat capacity of the nip plate 130. Therefore, the halogen lamp 120 can heat the nip plate 130 promptly. Further, prompt heating to the nip plate 130 can accelerate start-up timing of the fixing device 100.

The fixing device 100 according to the present embodiment includes the reflection member 150. Thus, radiant heat from the halogen lamp 120 can be efficiently concentrated onto the nip plate 130, which leads to the further compact nip plate 130. Accordingly, start-up timing of the fixing device 100 can be further accelerated.

The tip portion 125 is formed so as to protrude from the glass tube body 121' in a direction that the sealed portion 124 is oriented. Therefore, it does not occur to the halogen lamp 120 that each sealed portion 124 protrudes from the 121' glass tube body in the upward/downward direction whereas the tip portion 125 protrudes from the glass tube body 121' in the frontward/rearward direction. Thus, the compact halogen lamp 120 in the frontward/rearward direction can be ensured, which reliably leads to the compact nip plate 130, reflection member 150, stay 160 in the frontward/rearward direction. Accordingly, the compact fixing device 100 can be reliably attained. Further, acceleration of start-up timing of the fixing device 100 can be attained.

Various modifications are conceivable.

Figure 5:
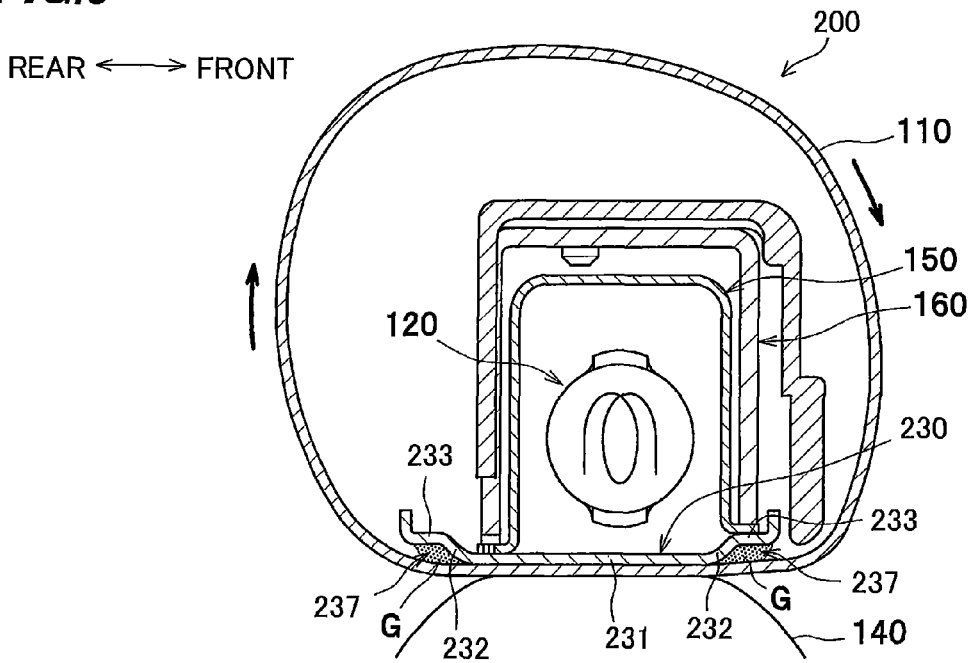
FIG. 5 is a schematic cross-sectional view of a fixing device according to a first modification of the present invention.

A fixing device 200 according to a first modification will be described while referring to FIG. 5. In the above-described embodiment, the nip plate 130 is provided with only a single retaining portion 137, connecting portion 132, and flange portion 133 at a position forward of the base portion 131. That is, the retaining portion 137, the connecting portion 132, and the flange portion 133 are only provided at a position upstream of the base portion 131 in the sheet feeding direction. However, as shown in FIG. 5, a nip plate 230 may be provided with a base portion 231, two connecting portions 232, two flange portions 233, and two retaining portions 237. One of the connecting portions 232, one of the flange portions 233, and one of the retaining portions 237 are positioned forward of the base portion 231, whereas remaining one of the connecting portions 232, remaining one of the flange portions 233, and remaining one of the retaining portions 237 are positioned rearward of the base portion 231. That is, a set of the connecting portion 232, the flange portion 233 and the retaining portion 237 is positioned upstream of the base portion 231 in the sheet feeding direction, whereas another set of the connecting portion 232, the flange portion 233, and the retaining portion 237 is positioned downstream of the base portion 231 in the sheet feeding direction.

A fixing device 300 according to a second modification will be described while referring to FIG. 6. In the above-described embodiment, the base portion 131 of the nip plate 130 is formed in a plate shape extending flat in the frontward/rearward direction. However, the term "plate shape" here implies a shape without an uneven portion or a folding portion. Accordingly, a nip plate 330 may have a curved base portion 331.

Figure 6:
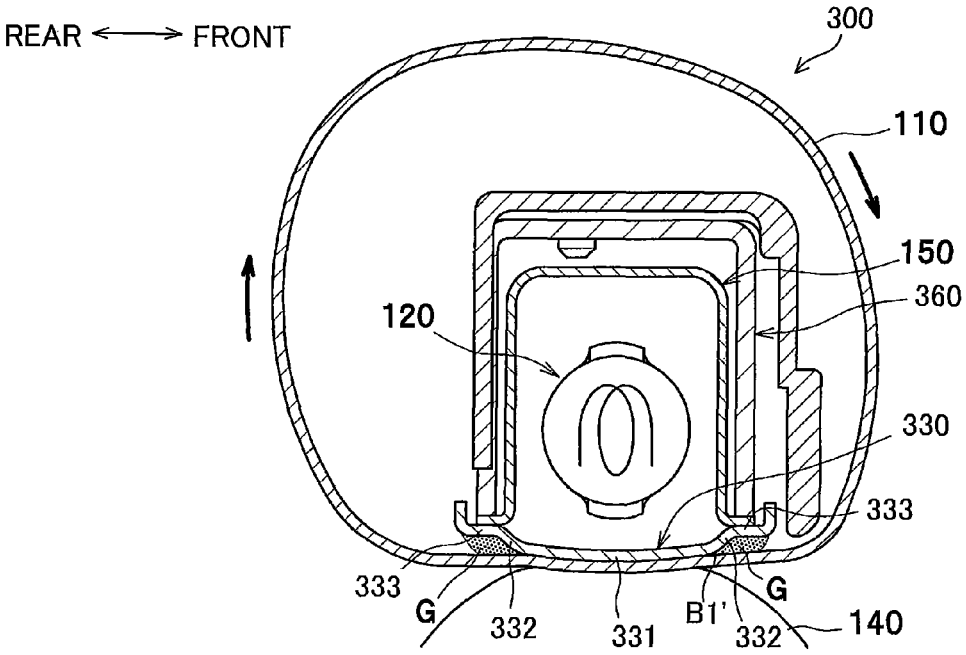
FIG. 6 is a schematic cross-sectional view of a fixing device according to a second modification of the present invention.

For example, as shown in FIG. 6, the base portion 331 (at least a surface with which the fusing belt 110 is in sliding contact) may curve in an arc shape with its convex side facing the pressure roller 140. Alternatively, although not shown in the drawing, the base portion 331 may curve in an arc shape with its convex side facing the halogen lamp 120. Note that, in order to realize smooth circular movement of the fusing belt 110, it is preferable that the base portion 331 has a curvature smaller than a curvature of a first curved portion B1' defined by the base portion 331 and a connecting portion 332.

Further, in the above-described embodiment, the stay 160 supports the flange portion 133 and the rear end portion of the base portion 131 of the nip plate 130. However, as shown in FIG. 6, in case the nip plate 330 may be provided with two flange portions 333 at positions forward and rearward of the base portion 331, a stay 360 may support the front and rear flange portions 333. At this time, the base portion 331 and the front and rear connecting portions 332 are positioned in direct confrontation with the halogen lamp 120.

Figure 7:
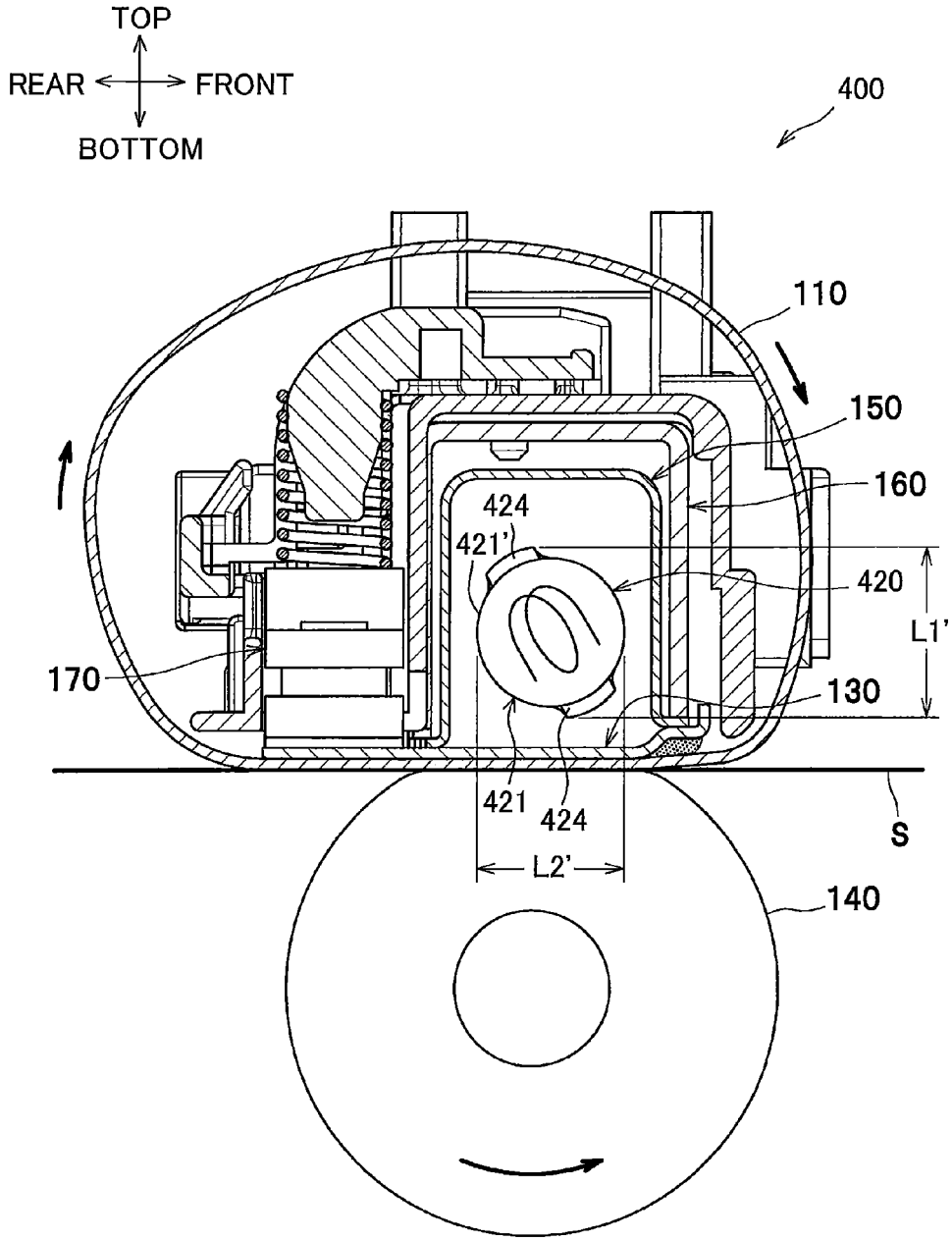
FIG. 7 is a schematic cross-sectional view of a fixing device according to a third modification of the present invention.

A fixing device 400 according to a third modification will be described while referring to FIG. 7. In the above-described embodiment, the halogen lamp 120 includes the glass tube 121 provided with the sealed portions 124, each oriented in the upward/downward direction. However, as shown in FIG. 7, a halogen lamp 420 may include a glass tube 421 provided with sealed portions 424, each oriented in a direction oblique to the upward/downward direction at a predetermined angle when viewing in the axial direction of the glass tube body 421'. In this modification, each sealed portions 424 is oriented in a direction closer to the upward/downward direction than to the frontward/rearward direction when viewing in the axial direction of the glass tube body 121'. Even in this case, in order to attain the compact fixing device 400 and to accelerate start-up timing of the fixing device 400, the halogen lamp 420 is disposed such that a cross-sectional distance L1' defined between an uppermost portion of the sealed portion 424 and a lowermost portion of the sealed portion 424 in the upward/downward direction is greater than the cross-sectional length L2' in the frontward/rearward direction.

As shown in FIGS. 3 and 7, preferably the sealed portions 124, 424 are oriented in a predetermined direction such that the cross-sectional length L2, L2' is equal to the diameter of the glass tube body 121', 421', respectively.

In the above-described embodiment, the fixing device 100 includes both of the reflection member 150 and the stay 160. However, the fixing device 100 may include either the stay 160 or the reflection member 150. Alternatively, both of the stay 160 and the reflection member 150 may be dispensed with.

Figure 8:
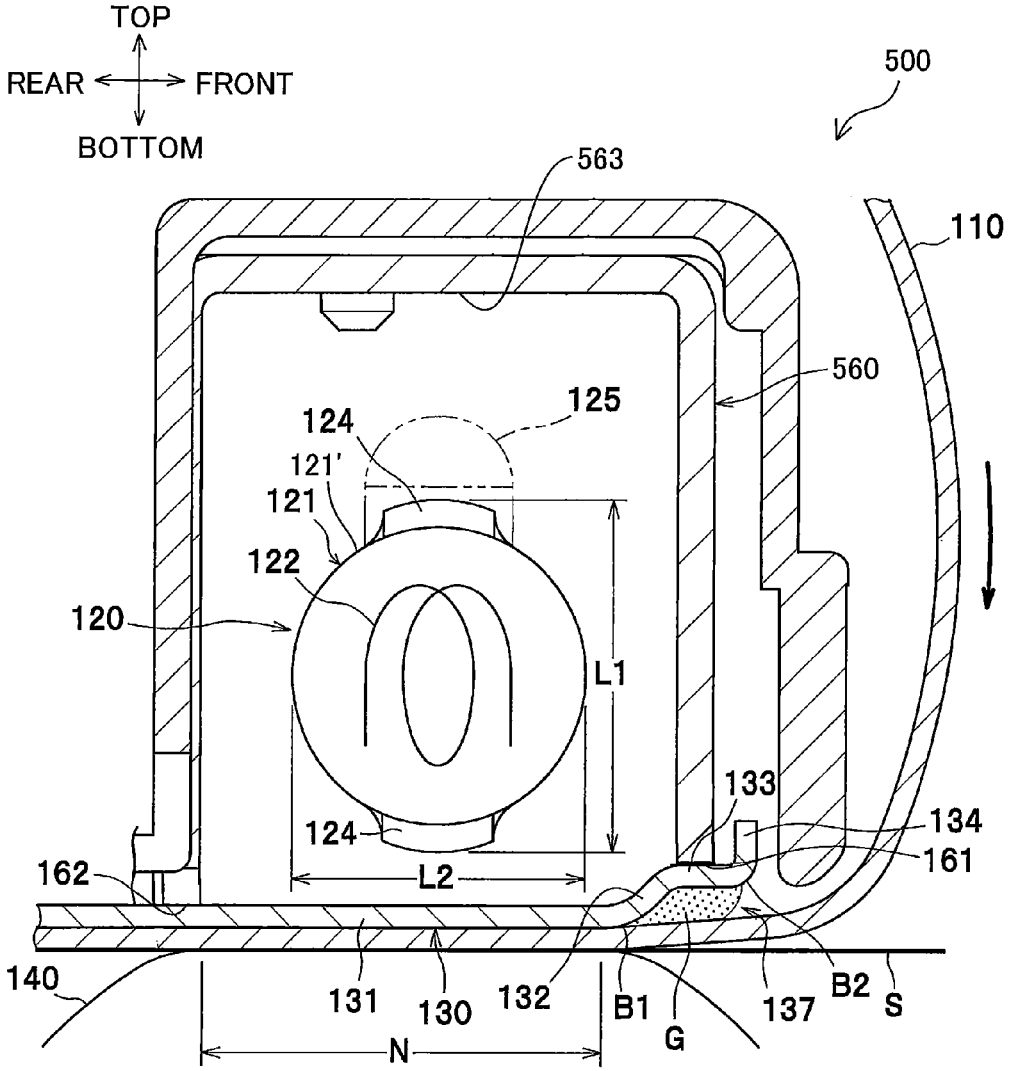
FIG. 8 is a schematic cross-sectional view of a fixing device according to a fourth modification of the present invention.

According to a fourth modification, a fixing device 500 shown in FIG. 8 includes a stay 560 but not the reflection member 150. The stay 560 has an inner surface confronting the halogen lamp 120 provided with a reflection surface 563. The reflection surface 563 is adapted to reflect the radiant heat from the halogen lamp 120 toward the nip plate 130. In other words, the stay 560 is integral with the reflection member 150.

With this configuration, radiant heat from the halogen lamp 120 can be efficiently concentrated onto the nip plate 130 to promptly heat the nip plate 130 and the fusing belt 110. Further, no particular space is required for installing the reflection member 150 in the fixing device 500 because the reflection surface 563 is provided in the stay 160 and the reflection member 150 is dispensed with. Accordingly, the stay 560 can be positioned as close as possible to the halogen lamp 120. Hence, the stay 560 and the nip plate 130 can be made more compact with respect to the frontward/rearward direction.

In the above-described embodiment, the nip plate 130 is provided with the prevention portion 134. However, the prevention portion 134 is optional and may be dispensed with.

In the above-described embodiment, the halogen lamp 120 is formed such that the tip portion 125 protrudes radially outwardly from the glass tube body 121' in the direction that each sealed portion 124 is oriented. However, the tip portion 125 may not necessarily protrude radially outwardly from the glass tube body 121' in this direction. In this case, the tip portion 125 may protrude radially outwardly from the glass tube body 121' in a direction offset at an angle of 20 degrees from the direction that each sealed portion 124 is oriented as long as the cross-sectional distance L1 in the upward/downward direction is greater than the cross-sectional length L2 in the frontward/rearward direction.

In the above-described embodiment, the fixing device 100 is adapted to heat the fusing belt 110 (tubular member) by the halogen lamp 120 (heater) via the nip plate 130. However, the fixing device 100 may be adapted to heat the tubular member directly by the heater. In other words, the nip plate 130 may not necessarily be heated by the heater.

Further, a carbon heater or an induction heater (IH) is available instead of the halogen lamp 120.

In the above-described embodiment, the reflection member 150 is employed as a backup member. However, a belt-like pressure member is also available.

Further, the sheet S can be an OHP sheet instead of plain paper and a postcard.

Further, in the above-described embodiment, the image forming device is the monochromatic laser printer. However, a color laser printer, a copying machine, and a multifunction device provided with an image reading device such as a flatbed scanner are also available.

While the invention has been described in detail with reference to the embodiment thereof, it would be apparent to those skilled in the art that various changes and modifications may be made therein without departing from the spirit of the invention.

What is claimed is:

1. A fixing device for thermally fixing a developing agent image to a sheet fed in a sheet feeding direction comprising:

a flexible tubular member having an inner peripheral surface defining an internal space;

a heater disposed in the internal space;

a nip member disposed in the internal space and made of a metal plate, the inner peripheral surface configured to be in sliding contact with the nip member;

a backup member configured to provide a nip region in cooperation with the nip member for nipping the flexible tubular member between the backup member and the nip member, the nip member including:

a base portion having a plate-shaped configuration provided with a first end and a second end positioned downstream of the first end in the sheet feeding direction, the nip region being defined exclusively by the base portion and the backup member;

a connecting portion extending from the first end of the base portion in a direction away from the backup member, the connecting portion having a first end and a second end connected to the first end of the base portion; and a flange portion extending from the first end of the connecting portion in a direction opposite to the sheet feeding direction, the connecting portion and the flange portion defining a retaining portion at a position confronting the inner peripheral surface of the flexible tubular member for retaining a lubricant agent therein, the retaining portion being formed by curving the metal plate; and a temperature detection member disposed in the internal space and configured to detect a temperature of the nip member, the nip member further including a protruding portion protruding from the second end of the base portion in the sheet feeding direction, the protruding portion having a first surface and a second surface opposite to the first surface and contacting the inner peripheral surface of the flexible tubular member, the temperature detection member being disposed on the first surface.

2. The fixing device as claimed in claim 1, further comprising a stay disposed in the internal space and opposite to the backup member relative to the nip member, the stay being configured to support the base portion and the flange portion when a force from the backup member is applied to the nip member.

3. The fixing device as claimed in claim 2, wherein the nip member is arranged such that the base portion and the connecting portion are in direct confrontation with the heater.

4. The fixing device as claimed in claim 2, wherein the nip member and the stay define an adjoining region therebetween, the flange portion having a first end and a second end connected to the first end of the connecting portion, wherein the nip member further includes a prevention portion extending from the first end of the flange portion in the direction away from the backup member and configured to prevent the lubricant agent from running into the adjoining region.

5. The fixing device as claimed in claim 1, wherein the tubular member has an axis defining an axial direction, and the backup member has a cylindrical configuration having an axis parallel to the axial direction and a diameter gradually increasing outward in the axial direction.

6. The fixing device as claimed in claim 1, wherein the nip member further includes a second connecting portion and a second flange portion, the second connecting portion extending from the second end of the base portion in the direction away from the backup member and having a first end connected to the second end of the base portion and a second end positioned downstream of the first end of the second connecting portion in the sheet feeding direction, the second flange portion extending from the second end of the second connecting portion in the sheet feeding direction, wherein the second connecting portion and the second flange portion define a retaining portion at a position confronting the inner peripheral surface of the flexible tubular member for retaining a lubricant agent therein, the retaining portion being formed by curving the metal plate.

7. The fixing device as claimed in claim 6, further comprising a stay disposed in the internal space and opposite to the backup member relative to the nip member, the stay being configured to support the flange portion and the second flange portion when a force from the backup member is applied to the nip member.

8. The fixing device as claimed in claim 7, wherein the nip member is arranged such that the base portion, the connecting portion, and the second connecting portion are in direct confrontation with the heater.

9. The fixing device as claimed in claim 1, wherein the base portion is flat.

10. The fixing device as claimed in claim 1, wherein the base portion is curved.

* * * * *